US009764358B2

(12) United States Patent
Walker

(10) Patent No.: US 9,764,358 B2
(45) Date of Patent: Sep. 19, 2017

(54) SCREEN ASSEMBLY FOR VIBRATORY SCREENING MACHINES

(71) Applicant: Screen Logix, LLC, Houston, TX (US)

(72) Inventor: Jeffrey Earl Walker, Lafayette, LA (US)

(73) Assignee: Strox Systems, LLC, League City, TX (US)

( * ) Notice: Subject to any disclaimer, the term of this patent is extended or adjusted under 35 U.S.C. 154(b) by 76 days.

(21) Appl. No.: 14/707,906

(22) Filed: May 8, 2015

(65) Prior Publication Data

US 2016/0325313 A1 Nov. 10, 2016

(51) Int. Cl.
*B07B 1/46* (2006.01)
*B07B 1/48* (2006.01)

(52) U.S. Cl.
CPC ..... *B07B 1/469* (2013.01); *B07B 1/4618* (2013.01); *B07B 1/4663* (2013.01); *B07B 1/48* (2013.01)

(58) Field of Classification Search
CPC B07B 1/46; B07B 1/4609; B07B 1/48; B07B 1/49; B07B 2201/02
USPC ..... 209/399, 403, 405, 408
See application file for complete search history.

(56) References Cited

U.S. PATENT DOCUMENTS

| | | | | |
|---|---|---|---|---|
| 6,669,027 | B1 | 12/2003 | Mooney et al. | |
| 7,228,971 | B2 † | 6/2007 | Mooney | |
| 7,344,032 | B2 * | 3/2008 | LaVeine | B07B 1/46 209/310 |
| 7,520,391 | B2 * | 4/2009 | Schulte, Jr. | B01D 29/012 209/405 |
| 8,757,392 | B2 * | 6/2014 | LaVeine | B07B 1/485 209/319 |
| 9,144,825 | B2 * | 9/2015 | Wojciechowski | B07B 1/4645 |
| 2004/0074819 | A1 * | 4/2004 | Burnett | B01D 33/0376 209/405 |
| 2007/0007181 | A1 † | 1/2007 | Barrett | |
| 2015/0283582 | A1 * | 10/2015 | Karl | B07B 1/485 209/412 |

* cited by examiner
† cited by third party

*Primary Examiner* — Joseph C Rodriguez
(74) *Attorney, Agent, or Firm* — Bushman Werner, P.C.

(57) ABSTRACT

Screen assemblies for vibratory screening machines are provided herein. A screen assembly comprising: a plate comprising: a center portion with a plurality of apertures, a first end having a first series of finger-receiving apertures, a second end having a second series of finger-receiving apertures, wherein the first and second ends of the plate extend to cover the first and second series of finger-receiving apertures; and a screen covering the plurality of apertures.

8 Claims, 2 Drawing Sheets

SCREEN ASSEMBLY FOR VIBRATORY SCREENING MACHINES

BACKGROUND

1. Field of the Invention

The present disclosure relates to screen assemblies for screening drilling muds, and more specifically, to screen assemblies for vibratory screening machines.

2. Background of the Invention

Vibratory screening machines are commonly utilized to remove drilled solids from drilling mud which is used to drill wellbores into a subterranean formation. Screen assemblies in the vibratory screening machines are vibrated as the drilling mud flows on top of the screen assemblies. The vibration causes the liquid phase of the mud and solids smaller than the wire mesh of the screen to pass through the screen, while large solids are retained on the screen and eventually fall of the back of the machines and are discarded. The removal of the drilled solids from the drilling mud allows the drilling mud to be reused.

Screen assemblies are typically mounted onto tensioning mechanisms in the vibratory screening machines. The tensioning mechanisms hold the screen under the required tension to control the vibration. Several methods exist for mounting screen assemblies onto the tensioning mechanisms of the vibratory screening machines. One method includes mounting the screen assemblies by inserting fingers on the tensioning mechanism into apertures on the screen assemblies.

BRIEF DESCRIPTION OF THE DRAWINGS

The present disclosure will be more fully understood by reference to the following detailed description of the preferred embodiments of the present disclosure when read in conjunction with the accompanying drawings, in which like reference numbers refer to like parts throughout the views wherein.

The disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes which come within the meaning and range of equivalency of the claims are therefore intended to be embraced therein.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

The present disclosure relates to screen assemblies for screening drilling muds. More particularly, the present disclosure relates to screen assemblies for vibratory screening machines. One conventional method for mounting screen assemblies onto vibratory screening machines utilizes finger-receiving apertures on the screen assemblies into which fingers of the tensioning mechanisms of the vibratory screening machines are inserted. When this method for mounting the screen assemblies is used, it is often desirable to prevent drilling mud and/or drilling solids from entering the finger-receiving apertures.

Among the many potential advantages to the screen assemblies of the present disclosure, only some of which are alluded to herein, the screen assemblies of the present disclosure may prevent drilling mud and/or drilling solids from entering the finger-receiving apertures by providing a solid cover over the finger-receiving apertures. The screen assemblies of the present disclosure also may allow for the a portion of the screen assembly to be recycled and/or reused after the screen portion has worn out by providing screen assemblies wherein the screen portion can be readily removed and replaced without having to deconstruct the remainder of the screen assembly.

Figure 1:
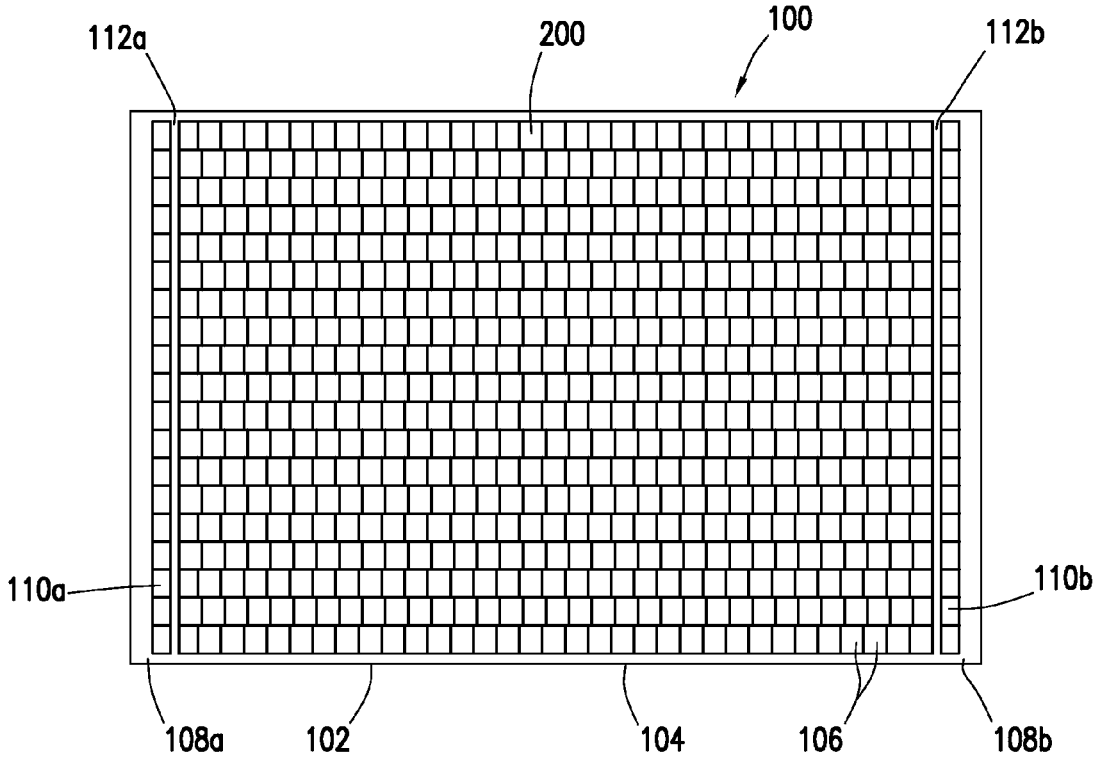
FIG. 1 depicts an underside view of a screen assembly in accordance with illustrative embodiments of the present disclosure.

FIG. 1 depicts an underside view of a screen assembly (100) in accordance with illustrative embodiments of the present disclosure. As shown in FIG. 1, the screen assembly (100) may comprise a plate (102). The plate (102) may be constructed from any suitable material that can withstand the forces applied to it by a vibratory screening machine, including, but not limited to, metal, such as steel, and plastic materials, such as high-strength plastic, mixtures of high-strength plastic and glass, high-strength plastic reinforced with high-tensile-strength steel rods, and any combination thereof. As shown in FIG. 1, the plate (102) comprises a center portion (104) with a plurality of apertures (106). The apertures (106) may be formed in the plate (102) by a punching operation. In some embodiments, the apertures (106) may be of uniform size and/or shape. In other embodiments, the apertures (106) may be of varying sizes and/or shapes. In certain embodiments, the dimensions of the apertures (106) may be from about 0.875 inch to about 1 inch by about 1 inch to about 1.25 inches. The apertures (106) may be arranged in any geometry required by the operating conditions of a vibratory screening machine. For example, in some embodiments, the apertures (106) may be arranged in rows that are offset from one another as depicted in FIG. 1. In other embodiments, the apertures (106) may be arranged in series. As shown in FIG. 1, the plate (102) also comprises a first end (108*a*) having a first series of finger-receiving apertures (110*a*) and a second end (108*b*) having second series of finger-receiving apertures (110*b*). In certain embodiments, the dimensions of the finger-receiving apertures (110*a*, 110*b*) may be from about 0.5 inch to 1 inch by about 0.875 inch to about 1.25 inches.

The screen assembly (100) also comprises a screen (200) covering the plurality of apertures (106). In certain embodiments, the screen (200) may be secured to the center portion (104) of the plate (102). The screen (200) may be secured to the plate (102) using any suitable material, including, but not limited to, epoxy and glue, and/or mechanical methods, including, but not limited to, screws, bolts, rivets, and welding.

Figure 2:
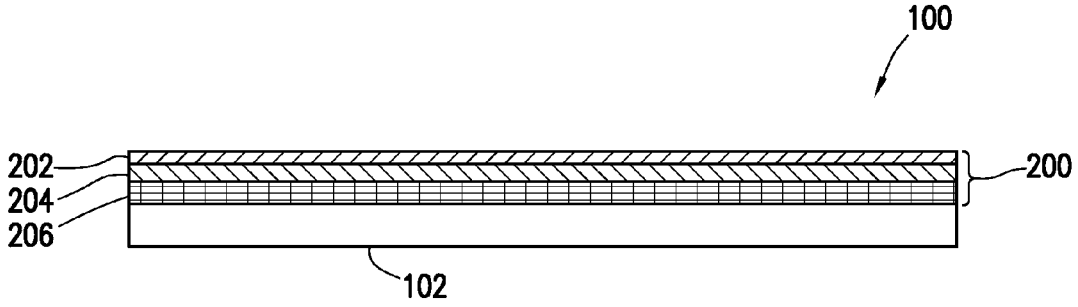
FIG. 2 depicts an enlarged cross-sectional view of a portion of a screen assembly in accordance with illustrative embodiments of the present disclosure.

FIG. 2 depicts an enlarged cross-sectional view of a portion of a screen assembly (100) in accordance with illustrative embodiments of the present disclosure. In certain embodiments, the screen (200) may comprise one or more layer of mesh screening material. For example, as illustrated in FIG. 2, the screen (200) may comprise a layer of heavy screening material (206), a layer of fine screening material (204), and/or a layer of finer screening material (202). The layers of screening material may be bonded together by a fused plastic grid having openings therein. In some embodiments, the screen (200) may be flat as illustrated in FIG. 2. In other embodiments, the screen (200) may be corrugated or undulating.

Figure 3:
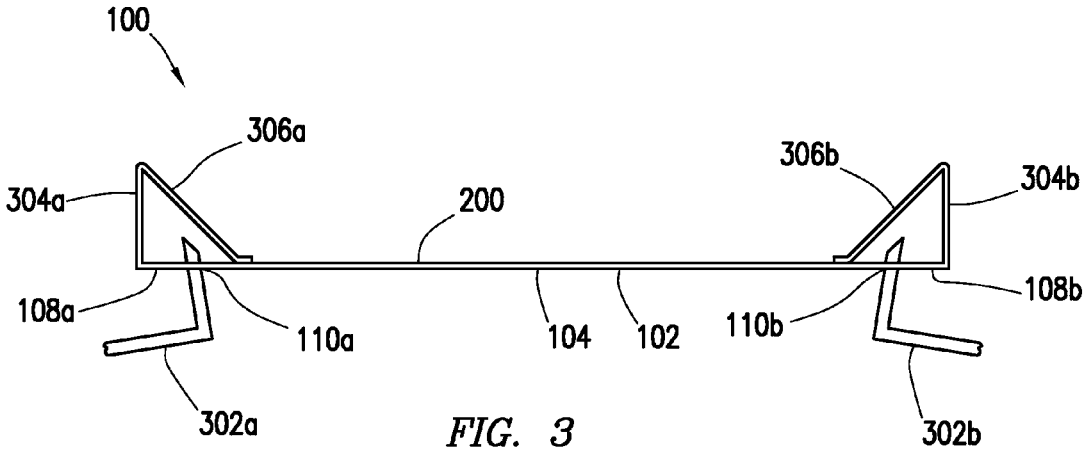
FIG. 3 depicts cross-sectional view of a screen assembly in accordance with illustrative embodiments of the present disclosure.

FIG. 3 depicts cross-sectional view of a screen assembly (100) in accordance with illustrative embodiments of the present disclosure. As illustrated in FIG. 3, fingers (302*a*, 302*b*) of a tensioning mechanism on a vibratory screening machine may be inserted into the first and second series of finger-receiving apertures (110*a*, 110*b*). In certain embodiments, the first and second ends (108*a*, 108*b*) of the plate (102) may extend to cover the first and second series of finger-receiving apertures (110*a*, 110*b*) to prevent the material being screened from entering the finger-receiving apertures (110*a*, 110*b*) and/or from interfering with the tensioning mechanism. In certain embodiments, the first end (108*a*) and the second end (108*b*) of the plate (102) may extend substantially perpendicular to the center portion (104) of the plate (102) to cover the first series of finger-receiving apertures (110*a*) and the second series of finger-receiving apertures (110*b*), respectively. In some embodiments, the first and second ends (108*a*, 108*b*) may be an formed from an extension of the plate (102). In other embodiments, the first and second ends (108*a*, 108*b*) may be separately formed and attached to the plate (102).

In certain embodiments, the first and second ends (108*a*, 108*b*) may each comprise a first section (304*a*, 304*b*) and a second section (306*a*, 306*b*). In certain embodiments, the first sections (304*a*, 304*b*) of the first and second ends (108*a*, 108*b*) may extend substantially perpendicular to the center portion (104) of the plate (102), and the second sections (306*a*, 306*b*) of the first and second ends (108*a*, 108*b*) may be angled to cover the first and second series of finger-receiving apertures (110*a*, 110*b*). The degree to which the second sections (306*a*, 306*b*) of the first and second ends (108*a*, 108*b*) are angled may be dependent on the geometry required by the operating conditions of a vibratory screening machine. In certain embodiments, the second sections (306*a*, 306*b*) of the first and second ends (108*a*, 108*b*) may be angled about 45 degrees relative to the first sections (304*a*, 304*b*) of the first and second ends (108*a*, 108*b*). In certain embodiments, the first sections (304*a*, 304*b*) and the second sections (306*a*, 306*b*) of the first and second ends (108*a*, 108*b*) may comprise a solid material without apertures.

Figure 4:
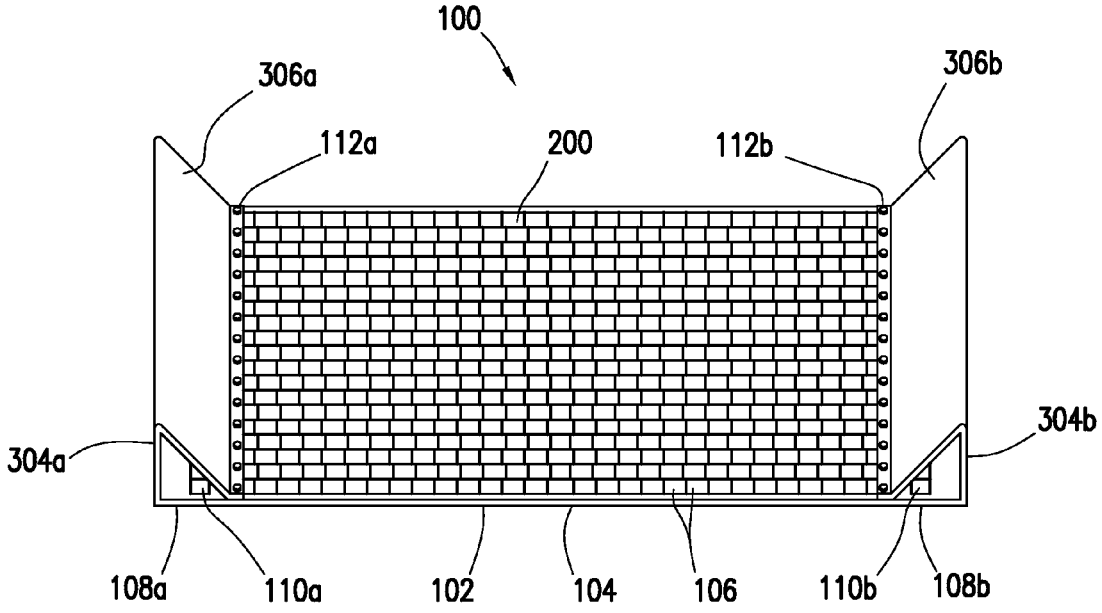
FIG. 4 depicts an overhead view of a screen assembly in accordance with illustrative embodiments of the present disclosure.

In certain embodiments, the second sections (306*a*, 306*b*) of the first and second ends (108*a*, 108*b*) may be secured to the plate (102). In certain embodiments, the second sections (304*a*, 304*b*) of the first and second ends (108*a*, 108*b*) may be secured to the plate (102) using any suitable fastener or means of mechanical attachment, including, but not limited to, rivets, screws, bolts, epoxy, expandable foam, welding (e.g., friction welding and spot welding) and any combination thereof. Referring again to FIG. 1, in certain embodiments, the plate (102) also may comprise a first strip (112*a*) located between the center portion (104) and the first end (108*a*) and a second strip (112*b*) located between the center portion (104) and the second end (108*b*). As illustrated in FIG. 4, the second sections (304*a*, 304*b*) of the first and second ends (108*a*, 108*b*) may, in certain embodiments, be secured to the plate (102) at the first strip (112*a*) and second strip (112*b*), respectively.

FIG. 4 depicts an overhead view of a screen assembly (100) in accordance with illustrative embodiments of the present disclosure. As shown in FIG. 4, the screen assembly (100) comprises a plate (102) comprising a center portion (104) with a plurality of apertures (106), a first end (108*a*) having a first series of finger-receiving apertures (110*a*), and second end (108*b*) having a second series of finger-receiving apertures (110*b*). The screen assembly (100) also comprises a screen (200) covering the plurality of apertures (106). The first and second ends (108*a*, 108*b*) of the plate (102) extend to cover the first and the second series of finger-receiving apertures (110*a*, 110*b*), respectively. In certain embodiments, the first and second ends (108*a*, 108*b*) of the plate (102) may each comprise a first section (304*a*, 304*b*) and a second section (306*a*, 306*b*). In certain embodiments, the first sections (304*a*, 304*b*) of the first and second ends (108*a*, 108*b*) may extend substantially perpendicular to the center portion (104) of the plate (102). In certain embodiments, the second sections (306*a*, 306*b*) of the first and second ends (108*a*, 108*b*) may be angled to cover the first and second series of finger-receiving apertures (110*a*, 110*b*). In certain embodiments, the second sections (306*a*, 306*b*) may be secured to the plate (102) at the first and second strips (112*a*, 112*b*) as illustrated in FIG. 4.

Therefore, the present disclosure is well-adapted to carry out the objects and attain the ends and advantages mentioned as well as those which are inherent therein. While the disclosure has been depicted and described by reference to exemplary embodiments of the disclosure, such a reference does not imply a limitation on the disclosure, and no such limitation is to be inferred. The disclosure is capable of considerable modification, alternation, and equivalents in form and function, as will occur to those ordinarily skilled in the pertinent arts and having the benefit of this disclosure. The depicted and described embodiments of the disclosure are exemplary only, and are not exhaustive of the scope of the disclosure. Consequently, the disclosure is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. A screen assembly comprising:

a monolithic frame, said frame including a substantially planar plate portion having a top surface, a bottom surface, a first end, a spaced second end, and a plurality of apertures extending therethrough, said frame further including a first end mount formed on and substantially coterminous with said first end and a second end mount formed on and substantially coterminous with said second end, each of said first and second end mounts having a vertical flange portion extending transverse to said plate portion and having a top end, a substantially planar strip portion substantially parallel and secured to said top surface, and a web portion interconnecting said strip portion and said top end of said flange portion; and a screen attached to said top surface of said plate.

2. The screen assembly of claim 1 wherein there are a plurality of open finger receiving formations in said plate under each of said first and second end mounts.

3. The screen assembly of claim 1 wherein said web portions are angled about 45 degrees relative to said plate portion.

4. The screen assembly of claim 1 wherein said strip portions are secured to said top surface using a material selected from the group consisting of: a rivet, a screw, a bolt, an epoxy, an expandable foam, a weld, and any combination thereof.

5. The screen assembly of claim 1 wherein said frame is metal or plastic.

6. The screen assembly of claim 1 wherein the screen is secured to the plate portion with epoxy.

7. The screen assembly of claim 1 wherein the screen comprises one or more layers of screening material.

8. The screen assembly of claim 1 wherein the plurality of apertures are arranged in series or offset rows.

* * * * *